United States Patent [19]

Hellwig et al.

[11] Patent Number: 5,053,935

[45] Date of Patent: Oct. 1, 1991

[54] LAMP/REFLECTOR UNIT

[75] Inventors: Pual Hellwig; Mackovika Bernd; Wolfgang Hahn, all of Aachen, Fed. Rep. of Germany

[73] Assignee: U.S. Philips Corporation, New York, N.Y.

[21] Appl. No.: 567,855

[22] Filed: Aug. 15, 1990

[30] Foreign Application Priority Data

Aug. 21, 1989 [NL] Netherlands ..... 8902102

[51] Int. Cl.[5] ..... F21V 17/04; H01J 5/48

[52] U.S. Cl. ..... 362/296; 313/113; 313/318; 362/341

[58] Field of Search ..... 362/61, 296, 341; 313/113, 318

[56] References Cited

U.S. PATENT DOCUMENTS

| | | | |
|---|---|---|---|
| 3,314,331 | 4/1967 | Wiley | 362/296 X |
| 4,371,807 | 2/1983 | Eckhardt | 313/318 |
| 4,384,236 | 5/1983 | Hellwig et al. | 313/318 |

*Primary Examiner*—Allen M. Ostrager
*Attorney, Agent, or Firm*—Robert J. Kraus

[57] ABSTRACT

The lamp/reflector unit comprises a reflector (1) having a neck-shaped portion (3) in which a metal centering member (9) is present. The centering member (9) has a transverse wall (10) with an opening (11) in which the seal (6) of an electric lamp (4) is accommodated, secured with cement (12). Recesses (13) extend from the opening (11) into the transverse wall (10). Fracture of the seal (6) is thus prevented.

2 Claims, 1 Drawing Sheet

LAMP/REFLECTOR UNIT

BACKGROUND OF THE INVENTION

The invention relates to a lamp/reflector unit comprising a concave reflector with an axis, which has near its top a neck-shaped portion around that axis, an electric lamp provided with a lamp vessel having a seal, an electric element in the lamp vessel, current supply conductors extending from the electric element through the seal to the exterior, a metal centring member in the neck-shaped portion having a transverse wall cross to the axis of the reflector, which wall has an opening in which the seal is accommodated, the lamp vessel being secured in the neck-shaped portion by means of cement.

Such lamp/reflector units are commercially available.

The centring member—a flat metal plate, a metal plate having a cylindrical rim, or a metal bush—facilitates assembly of the lamp in the reflector in a pre-determined position of the electric element relative to the reflector owing to the fact that the member centres the seal in the neck-shaped portion. By shifting and/or tilting the lamp vessel, it is possible to bring the electric element in the correct position. The centring member also has for its object to prevent the cement from flowing from the neck-shaped portion before it has set and from being deposited on the reflector.

It has been shown that fractures of the lamp vessels frequently occur in these lamp/reflector units. The seal of the lamp vessel breaks in the spot where that seal emerges from the centring member.

SUMMARY OF THE INVENTION

The invention has for its object to provide a lamp/reflector unit of the type described in the opening paragraph which amongst others is of a simple construction and in which fracture of the lamp vessel is avoided.

This object, according to the invention, is achieved in that recesses extend from the opening in the transverse wall of the centring member into that transverse wall.

The invention is based on the recognition of the fact that the curing of the cement causes strain in the seal of the lamp vessel. At the surface of the cement mass remote from the reflector this compound has room to expand and thus to relieve strain. The part of the cement mass facing the reflector does not have this possibility in the known unit owing to the fact that the centring member is present there.

The measure according to the invention gives the centring member flexibility in the axial direction of the reflector. The result is that strain in the cement mass, and thus in the seal, is reduced.

The number and locations of the incisions depend on the nature and the thickness of the material of the centring member, the properties of the cement mass, and the temperature/time curve traversed during curing of the cement mass. It is easy for those skilled in the art, however, to determine the required configuration of the incisions for a given lamp by means of a few test samples.

It has been shown that good results are obtained with recesses which have been applied, for example, through die punching and which extend along the neck-shaped portion.

It is of no importance for the essence of the invention whether the electric element is an incandescent body, whether or not in a halogen-containing gas, or a pair of electrodes in an ionizable medium.

The concave reflector is usually made of metal or glass.

The centring member may be included in the neck-shaped portion with clamping fit, it may be secured in it by means of the cement compound holding the lamp vessel, or it may be fixed in it by means of indentations in the neck-shaped portion, or by means of welded or soldered joints.

BRIEF DESCRIPTION OF THE DRAWING

An embodiment of a lamp/reflector unit is shown in the drawing, in which.

DESCRIPTION OF THE PREFERRED EMBODIMENT

Figure 1:
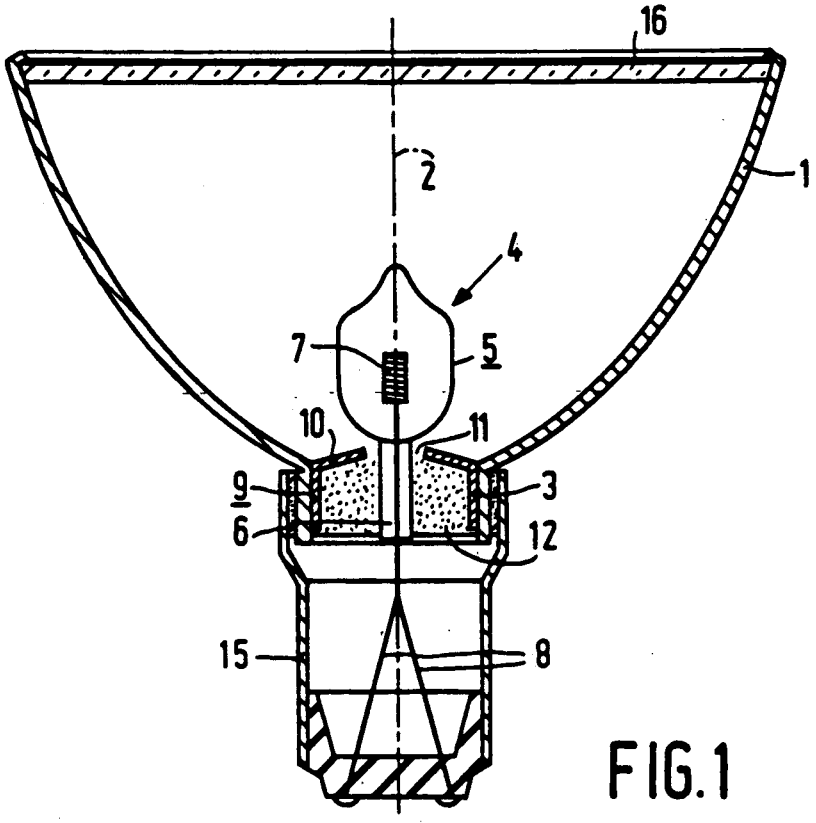
FIG. 1 shows a lamp/reflector unit in axial section.

In FIG. 1 the lamp/reflector unit has a concave reflector 1 with an axis 2, which has near its apex a neck-shaped portion 3 around that axis 2. The reflector 1 shown is of metal, for example aluminium.

An electric lamp 4 is provided with a lamp vessel 5 having a seal 6. An electric element 7, an incandescent body, is arranged in the lamp vessel. Current supply conductors 8 extend from the electric element 7 through the seal 6 to the exterior.

In the neck-shaped portion 3 there is a metal centring member 9 having a transverse wall 10 at right angles to the axis 2 of the reflector 1, which wall has an opening 11 (FIG. 2) in which the seal 6 is accommodated.

The lamp vessel 5 is fixed in the neck-shaped portion 3 with cement 12. In the Figures the centring member 9 has the shape of a bush, the base of which is the transverse wall 10. The centring member 9 is applied in the neck-shaped portion 3 with clamping fit.

Figure 2:
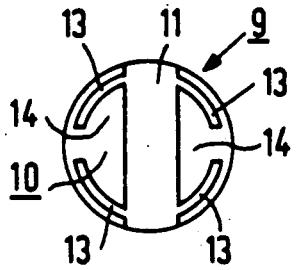
FIG. 2 shows the front view of the centring member.

In the centring member shown in FIG. 2 recesses 13 extend from the opening 11 in the transverse wall 10 of the centring member 9 (FIG. 2), substantially along the neck-shaped portion 3 (FIG. 1).

In the unit shown in FIG. 1 the centring member 9 is made of brass with a thickness of 0.2 mm, while the reflector 1 is made of aluminium. The recesses 13 run as circular arcs in the transverse wall 10, thus forming flexible tongues 14 (FIG. 2) in that wall. FIG. 1 shows exaggeratedly that these tongues 14 are pressed outwards by the cement mass 12 from the original flat plane of the transverse wall 10.

In FIG. 1, a lamp cap 15 is fixed around a neck-shaped portion 3, but alternatively the current supply conductors 8 may act as contact pins. The reflector 1 is closed off with a glass plate 16.

It has been shown that a fracture of the lamp vessel is effectively counteracted by the measure according to the invention.

What is claimed:

1. Lamp/reflector unit comprising a concave reflector (1) with an axis (2), which has near its top a neck-shaped portion (3) around that axis, an electric lamp (4) provided with a lamp vessel (5) having a seal (6), an electric element (7) in the lamp vessel, current supply conductors (8) extending from the electric element through the seal to the exterior, a metal centring member (9) in the neck-shaped portion (3) having a transverse wall (10) cross to the axis (2), of the reflector (1), which wall has an opening (11) in which the seal (6) is accommodated, the lamp vessel being secured in the neck-shaped portion by means of cement (12), characterized in that recesses (13) extend from the opening (11) in the transverse wall (10) of the centring member (9) into that transverse wall.

2. Lamp/reflector unit as claimed in claim 1, characterized in that the recesses (13) substantially extend along the neck-shaped portion (3).

* * * * *